US008022628B2

(12) United States Patent
Sogou et al.

(10) Patent No.: US 8,022,628 B2
(45) Date of Patent: Sep. 20, 2011

(54) PLASMA DISPLAY PANEL INCORPORATING A HYDROGEN-ABSORBING MATERIAL

(75) Inventors: Hiroshi Sogou, Hyogo (JP); Shigeyuki Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 145 days.

(21) Appl. No.: 12/440,514

(22) PCT Filed: Nov. 5, 2008

(86) PCT No.: PCT/JP2008/003170

§ 371 (c)(1),
(2), (4) Date: Mar. 9, 2009

(87) PCT Pub. No.: WO2009/060591

PCT Pub. Date: May 14, 2009

(65) Prior Publication Data

US 2010/0176710 A1 Jul. 15, 2010

(30) Foreign Application Priority Data

Nov. 5, 2007 (JP) ..... 2007-286985

(51) Int. Cl.
*H01J 17/49* (2006.01)
*H01J 17/24* (2006.01)
*H01J 61/26* (2006.01)

(52) U.S. Cl. ..... 313/582; 313/586; 313/587; 313/547; 313/549; 313/553

(58) Field of Classification Search ..... 313/582–587
See application file for complete search history.

(56) References Cited

U.S. PATENT DOCUMENTS

| | | | | |
|---|---|---|---|---|
| 5,982,095 | A | 11/1999 | Jin et al. | |
| 7,425,164 | B2 | 9/2008 | Tanaka et al. | |
| 7,733,023 | B2 * | 6/2010 | Longoni et al. | 313/582 |
| 2006/0232207 | A1 | 10/2006 | Sugimoto et al. | |
| 2008/0020668 | A1 | 1/2008 | Longoni et al. | |

FOREIGN PATENT DOCUMENTS

| | | |
|---|---|---|
| JP | 5-342991 | 12/1993 |
| JP | 9-120778 | 5/1997 |
| JP | 9-245697 | 9/1997 |
| JP | 09-245697 | 9/1997 |
| JP | 11-86738 | 3/1999 |
| JP | 2002-75170 | 3/2002 |
| JP | 2002-531918 | 9/2002 |
| JP | 2003-303555 | 10/2003 |

(Continued)

OTHER PUBLICATIONS

International Search Report issued Dec. 9, 2008 in the International (PCT) Application No. PCT/JP2008/003170.

(Continued)

*Primary Examiner* — Mariceli Santiago
(74) *Attorney, Agent, or Firm* — Wenderoth, Lind & Ponack, L.L.P.

(57) ABSTRACT

A plasma display panel has a front substrate including a plurality of display electrode pairs, a dielectric layer, and a protective layer, and a rear substrate including a plurality of data electrodes, a barrier rib, and a phosphor layer. The front substrate and rear substrate face each other so that the display electrode pairs and the data electrodes intersect, and a hydrogen-absorbing material containing palladium is disposed inside the plasma display panel.

5 Claims, 3 Drawing Sheets

10

FOREIGN PATENT DOCUMENTS

| | | | | |
|---|---|---|---|---|
| JP | 2005-294255 | | | 10/2005 |
| JP | 2005-302549 | | | 10/2005 |
| JP | 2005302548 | A | * | 10/2005 |
| JP | 2008-507109 | | | 3/2008 |
| KR | 2001-0004168 | | | 1/2001 |
| KR | 10-2005-0010757 | | | 1/2005 |
| KR | 2007043545 | A | * | 4/2007 |
| WO | 00/33347 | | | 6/2000 |
| WO | 2005/088668 | | | 9/2005 |
| WO | 2006/008770 | | | 1/2006 |

OTHER PUBLICATIONS

Partial English translation of South Korean Office Action issued Nov. 1, 2010 in corresponding South Korean Application No. 10-2009-7008572.

* cited by examiner

PLASMA DISPLAY PANEL INCORPORATING A HYDROGEN-ABSORBING MATERIAL

This Application is a U.S. National Phase Application of PCT International Application PCT/JP2008/003170

BACKGROUND OF THE INVENTION

I. Technical Field

The present invention relates to a plasma display panel used for image display.

II. Description of the Related Art

Recently, plasma display panels (hereinafter referred to as "PDP") have received attention as color display devices capable of having a large screen and being thin and light in weight.

An AC surface discharge type PDP typical as a PDP has many discharge cells between a front substrate and a rear substrate that face each other. The front substrate has the following elements:

- a plurality of display electrode pairs disposed in parallel on a glass substrate; and
- a dielectric layer and a protective layer that are formed so as to cover the display electrode pairs.

In such a front substrate, each display electrode pair is formed of a pair of scan electrode and sustain electrode. The protective layer is a thin film made of alkali earth oxide such as magnesium oxide (MgO), protects the dielectric layer from ion spatter, and stabilizes the discharge characteristic such as breakdown voltage. The rear substrate has the following elements:

- a plurality of data electrodes disposed in parallel on a glass substrate;
- a dielectric layer formed so as to cover the data electrodes;
- a mesh barrier rib disposed on the dielectric layer; and
- a phosphor layer disposed on the surface of the dielectric layer and on the side surfaces of the barrier rib.

The front substrate and rear substrate face each other so that the display electrode pairs and the data electrodes three-dimensionally intersect, and are sealed. Discharge gas is filled into a discharge space in the sealed product. Discharge cells are formed in intersecting parts of the display electrode pairs and the data electrodes. In a PDP having this structure, ultraviolet rays are emitted by gas discharge in each discharge cell. The ultraviolet rays excite respective phosphors of red, green, and blue to emit light, and thus provide color display.

A subfield method is generally used as a method of driving the PDP. In this method, one field period is divided into a plurality of subfields, and the subfields at which light is emitted are combined, thereby performing gradation display. Each subfield has an initializing period, an address period, and a sustain period. In the initializing period, initializing discharge occurs in each discharge cell, and a wall charge required for a subsequent address discharge is formed. In the address period, address discharge is selectively caused in a discharge cell where display is to be performed, thereby forming a wall charge required for a subsequent sustain discharge. In the sustain period, a sustain pulse is alternately applied to the scan electrodes and the sustain electrodes, sustain discharge is caused in the discharge cell having undergone the address discharge, and a phosphor layer of the corresponding discharge cell is light-emitted, thereby displaying an image.

The PDP is manufactured by a front substrate preparing process, a rear substrate preparing process, a sealing process, an exhausting process, and a discharge gas supplying process. In the sealing process, the front substrate prepared in the front substrate preparing process is stuck to the rear substrate prepared in the rear substrate preparing process. In the exhausting process, gas is exhausted from the space inside the PDP. Since the front substrate is stuck to the rear substrate using frit in the sealing process, they are superimposed on each other and are fired at the temperature of a softening point of the frit or higher, for example, at about 440° C. to 500° C.

Impure gas such as water ($H_2O$), carbon dioxide gas (CO, $CO_2$), and hydrocarbon ($C_nH_m$) is exhausted from the frit or the like, and part of the impure gas is adsorbed into the PDP. The air inside the PDP and the impure gas are exhausted in the subsequent exhausting process. However, it is difficult to completely exhaust all gases including the impure gas adsorbed in the PDP, and some impure gas inevitably remains inside the PDP. Additionally, as the screen size and definition of the PDP have been recently increased, the remaining amount of the impure gas is apt to increase.

However, it is known that the material of the protective layer or phosphor reacts with the impure gas and its characteristic degrades. Especially, significant water remaining inside the PDP adversely affects the discharge characteristic of the protective layer, reduces the breakdown voltage of the discharge cells, and causes a "bleeding" degradation of the image quality on the display screen, disadvantageously. When a still image is displayed for a long time, "burning into" is caused, i.e., the image becomes an afterimage, disadvantageously. The hydrocarbon reduces the surface of the phosphor, or degrades the light emission luminance of the phosphor, disadvantageously.

Therefore, it is one of the important issues that the impure gas remaining inside the PDP, especially water and hydrocarbon, is reduced, the discharge characteristic is stabilized, and variation with time is suppressed. As a method of removing the impure gas, an attempt where water is removed by disposing an adsorbent such as crystalline aluminosilicate, γ activated alumina, or amorphous activated silica inside the PDP is disclosed in Japanese Patent Unexamined Publication No. 2003-303555, for example. An attempt where water is removed by disposing a magnesium oxide film in a region other than the image display region inside the PDP is disclosed in Japanese Patent Unexamined Publication No. H05-342991. An attempt where hydrocarbon gas is removed by disposing an oxide or an adsorbent in a region other than the image display region inside the PDP is disclosed in International Publication No. 2005/088668 Brochure. Here, the adsorbent is produced by adding a platinum-group element as hydrocarbon decomposing catalyst to the oxide. The oxide is alumina ($Al_2O_3$), yttrium oxide ($Y_2O_3$), lanthanum oxide ($La_2O_3$), magnesium oxide (MgO), nickel oxide (NiO), manganese oxide (MnO), chrome oxide ($CrO_2$), zirconium oxide ($ZrO_2$), iron oxide ($Fe_2O_3$), barium titanate ($BaTiO_3$), or titanium oxide ($TiO_2$). Japanese Patent Unexamined Publication No. 2002-531918 discloses an attempt where a metal getter such as zircon (Zr), titanium (Ti), vanadium (V), aluminum (Al), or iron (Fe) is disposed on the barrier rib in the PDP and an organic solvent is absorbed.

In spite of these attempts, it is difficult to sufficiently remove impure gas such as water, hydrocarbon, or organic solvent, and it is difficult to suppress the degradation of the protective layer and phosphor.

SUMMARY OF THE INVENTION

The present invention addresses these problems, and provides a PDP that sufficiently removes impure gas, such as water or hydrocarbon, and suppresses the degradation of the protective layer and phosphor.

The plasma display panel has a front substrate including a plurality of display electrode pairs, a dielectric layer, and a protective layer, and a rear substrate including a plurality of data electrodes, a barrier rib, and a phosphor layer. The front substrate and rear substrate are faced to each other so that the display electrode pairs and the data electrodes intersect, and a hydrogen-absorbing material containing palladium inside is disposed.

DETAILED DESCRIPTION OF THE INVENTION

PDPs in accordance with exemplary embodiments of the present invention will be described hereinafter with reference to the accompanying drawings.

First Exemplary Embodiment

Figure 1:
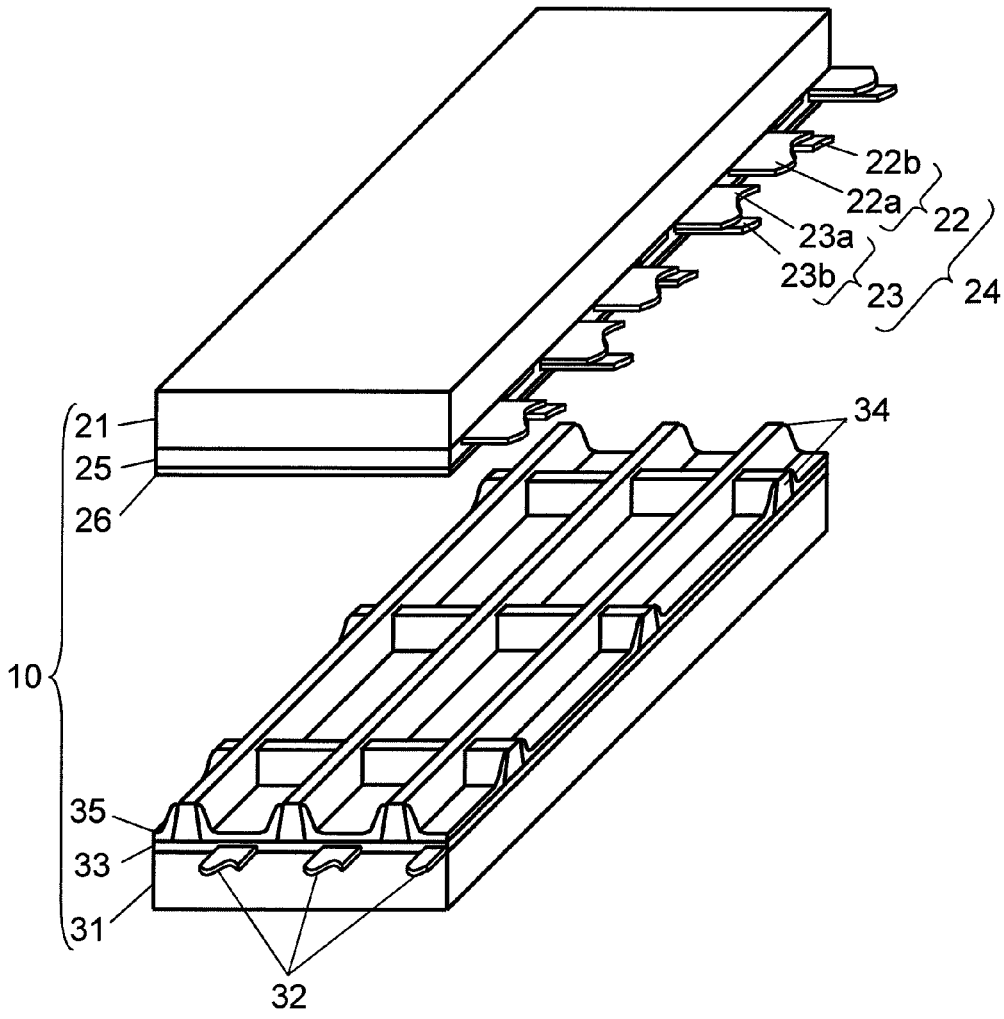
FIG. 1 is an exploded perspective view showing a structure of a PDP in accordance with a first exemplary embodiment of the present invention.
Figure 2:
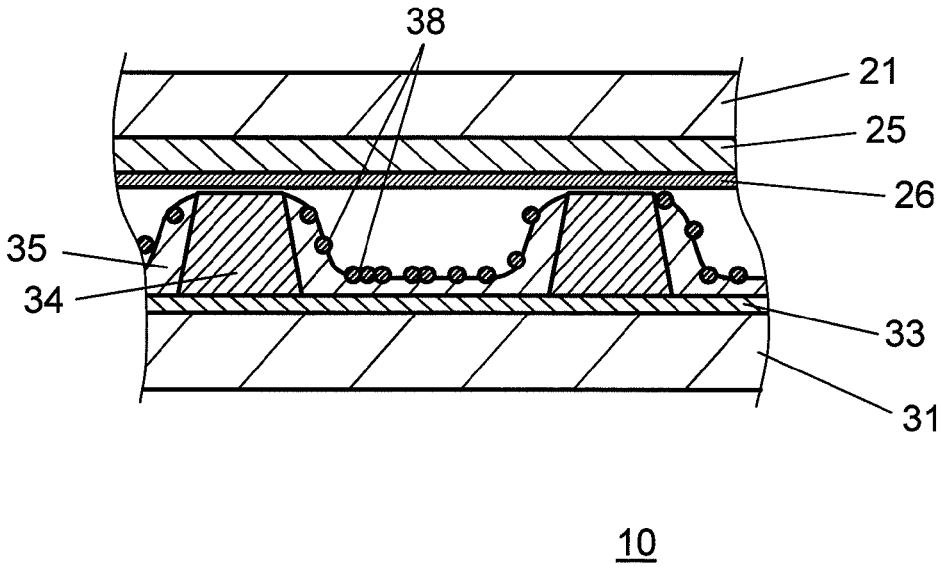
FIG. 2 is a sectional view of the PDP in accordance with the first exemplary embodiment of the present invention.

FIG. 1 is an exploded perspective view showing a structure of a PDP in accordance with a first exemplary embodiment of the present invention. FIG. 2 is a sectional view of the PDP in accordance with the first exemplary embodiment of the present invention. PDP 10 is formed by sticking glass-made front substrate 21 to rear substrate 31. A plurality of display electrode pairs 24 formed of scan electrodes 22 and sustain electrodes 23 are disposed on front substrate 21. Dielectric layer 25 is formed so as to cover display electrode pairs 24, and protective layer 26 is formed on dielectric layer 25. A plurality of data electrodes 32 are formed on rear substrate 31, dielectric layer 33 is formed so as to cover data electrodes 32, and mesh barrier rib 34 is formed on dielectric layer 33. Phosphor layer 35 for emitting lights of respective colors of red, green, and blue is formed on the side surfaces of barrier rib 34 and on dielectric layer 33.

In the first exemplary embodiment, hydrogen-absorbing materials 38 for selectively absorbing and storing hydrogen are disposed on phosphor layer 35. FIG. 2 is a sectional view of the PDP in accordance with the first exemplary embodiment of the present invention, and schematically shows the state where hydrogen-absorbing materials 38 are dispersed on phosphor layer 35 applied to rear substrate 31. Hydrogen-absorbing materials 38 whose grain size is 0.1 to 20 μm are used in the first exemplary embodiment. The coverage factor at which hydrogen-absorbing materials 38 cover phosphor layer 35 is set to 50% or lower so as to prevent light emission of phosphor from being disturbed.

In FIG. 2, hydrogen-absorbing materials 38 are dispersed so as to be interspersed on phosphor layer 35, but a similar effect can be obtained also when hydrogen-absorbing materials 38 are dispersed in phosphor layer 35.

Front substrate 21 and rear substrate 31 face each other so that display electrode pairs 24 cross data electrodes 32 with a micro discharge space sandwiched between them, and the outer peripheries of them are stuck and sealed by a sealing material (not shown) such as frit. The discharge space is filled with discharge gas containing xenon (Xe), for example. The discharge space is partitioned into a plurality of sections by barrier rib 34. Discharge cells are formed in the intersecting parts of display electrode pairs 24 and data electrodes 32. The discharge cells discharge and emit light to display an image. The structure of PDP 10 is not limited to the above-mentioned one. For example, dielectric layer 33 may be eliminated, and barrier rib 34 may have a striped shape.

Next, the material of PDP 10 is described. Each scan electrode 22 is formed by stacking narrow bus electrode **22*b* containing metal such as silver (Ag) on wide transparent electrode 22*a* made of conductive metal oxide in order to improve the conductivity. The conductive metal oxide used for transparent electrode 22*a* is indium tin oxide (ITO), tin oxide ($SnO_2$), or zinc oxide (ZnO). Each sustain electrode 23 is similarly formed by stacking narrow bus electrode 23*b* on wide transparent electrode 23*a*. Dielectric layer 25 is made of bismuth oxide based low-melting glass or zinc oxide based low-melting glass. Protective layer 26 is a thin film layer made of alkaline earth oxide mainly containing magnesium oxide. Each data electrode 32 is made of a material that contains metal such as silver and has high conductivity. Dielectric layer 33 may be made of a material similar to that of dielectric layer 25, but may be made of a material in which titanium oxide is mixed so as to serve also as a visible light reflecting layer. Barrier rib 34 is made of a low-melting glass material, for example. For phosphor layer 35**, $BaMgAl_{10}O_{17}$:Eu can be used as blue phosphor, $Zn_2SiO_4$:Mn can be used as green phosphor, and $(Y,Gd)BO_3$:Eu can be used as red phosphor. However, the present invention is not limited to these phosphors.

Hydrogen-absorbing materials 38 for absorbing and storing hydrogen can be platinum-group powder of one or more of platinum (Pt), palladium (Pd), ruthenium (Ru), rhodium (Rh), iridium (Ir), and osmium (Os). Among them, palladium is especially preferable. Hydrogen-absorbing materials 38 may be a compound of one or more of platinum, palladium, ruthenium, rhodium, iridium, and osmium and one of titanium (Ti), manganese (Mn), zirconium (Zr), nickel (Ni), cobalt (Co), lanthanum (La), iron (Fe), and vanadium (V). In this case, also, an alloy containing palladium is preferable.

As a method of dispersing hydrogen-absorbing materials 38 on phosphor layer 35, a spray method can be used. As a method of dispersing hydrogen-absorbing materials 38 in phosphor layer 35, the platinum-group powder is previously mixed when phosphor layer 35 is formed. Preferably, the grain size of the platinum-group powder is 0.1 to 20 μm, and the mixing ratio to powder of the phosphor is 0.01% to 2%. The filling factor of the phosphor in phosphor layer 35 is low, namely 60% or lower, so that the effect of absorbing and storing hydrogen is kept even when the platinum-group powder is dispersed in phosphor layer 35.

The thickness of dielectric layer 25 of PDP 10 in the present embodiment is 40 μm, and the thickness of protective layer 26 is 0.8 μm, for example. The height of barrier rib 34 is 0.12 mm, and the thickness of phosphor layer 35 is 15 μm, for example. The discharge gas is mixed gas of neon (Ne) and xenon (Xe), for example, the gas pressure of the discharge gas is $6\times10^4$ Pa, and the content of xenon is 10 vol % or more, for example.

Next, the function of hydrogen-absorbing materials 38 is described. A metal getter or an oxide getter is conventionally used for removing water or hydrocarbon, but such impure gas has a large molecular diameter and hence does not sufficiently infiltrate into the getter, and the adsorbing amount of the impure gas is restricted.

Inventors pay attention to the fact that discharging the PDP causes impure gas to be exhausted from the protective layer, barrier rib, and phosphor layer, and the water molecules and hydrocarbon molecules in the impure gas are decomposed into hydrogen atoms, oxygen atoms, and carbon atoms. The inventors pay attention to the fact that the platinum-group elements have a property of absorbing and storing much hydrogen, and consider that the water or hydrocarbon can be removed by making the platinum-group elements absorb and store hydrogen atoms of small radius.

The inventors prepare a PDP where the powder of the platinum-group elements or the alloy powder of the platinum-group elements and transition metal is applied to the upside of the phosphor layer, the top of the barrier rib, and the upside of the protective layer. Here, this application is performed using a printing method, a spray method, a photo-lithography method, a dispenser method, or an ink jet method. The platinum-group elements are platinum, palladium, ruthenium, rhodium, iridium, or osmium. The transition metal is titanium, manganese, zirconium, nickel, cobalt, lanthanum, iron, and vanadium. The powder of the platinum-group elements is kneaded with an organic binder as required, and is used in a paste form. The platinum-group elements are applied to a part where discharge occurs during image display of the PDP or near the part.

An image is displayed using the prepared PDP, and existence of "bleeding" and "burning into" is visually recognized for about 1000 hours. As a result, reduction of the image quality degradation by the "bleeding" and "burning into" can be recognized. Especially, when the powder containing palladium is used, it can be recognized that the image quality degradation hardly occurs. When the powder containing palladium is used, it can be also recognized that the light emission luminance of the phosphor hardly reduces. That is considered to be because the water molecules and hydrocarbon molecules are decomposed into hydrogen atoms, oxygen atoms, and carbon atoms, the platinum-group elements, especially palladium, absorb and store much hydrogen, and hence the water molecules and hydrocarbon molecules are significantly reduced though oxygen and carbon remain.

As is clear from this experiment, when the platinum-group elements, especially palladium, are used as hydrogen-absorbing materials 38, hydrogen-absorbing materials 38 absorb and store the hydrogen generated by decomposition following the discharge and hence can significantly reduce the water molecules and hydrocarbon molecules. Additionally, the discharge characteristic is stabilized, the variation with time is suppressed, and the luminance reduction of the phosphor can be suppressed.

In the first exemplary embodiment, hydrogen-absorbing materials 38 are dispersed on or in phosphor layer 35. However, the present invention is not limited to this. The exemplary embodiment where hydrogen-absorbing materials 38 are disposed at another part is described.

Second Exemplary Embodiment

Figure 3:
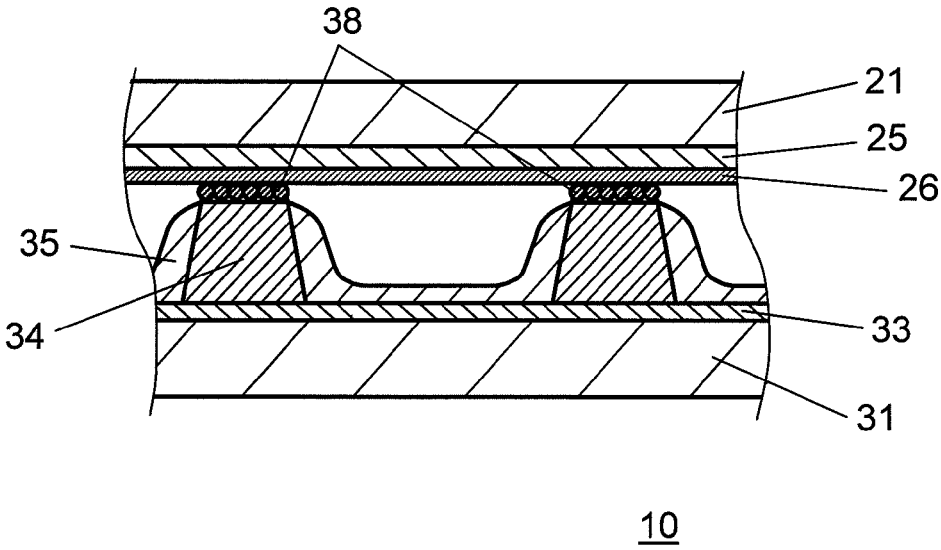
FIG. 3 is a sectional view of the PDP in accordance with a second exemplary embodiment of the present invention.

PDP 10 of the second exemplary embodiment of the present invention differs from the first exemplary embodiment in that hydrogen-absorbing materials 38 are disposed on the surface of barrier rib 34, especially on the top of barrier rib 34, in the second exemplary embodiment. FIG. 3 is a sectional view of the PDP 10 in accordance with the second exemplary embodiment of the present invention, and schematically shows hydrogen-absorbing materials 38 that are disposed on the top of barrier rib 34.

The grain size of the platinum-group powder used as hydrogen-absorbing materials 38 in the second exemplary embodiment must be set so that a large distance does not occur between barrier rib 34 and protective layer 26, and is preferably 0.1 to 5 μm. The thickness of the platinum-group powder layer is also preferably 5 μm or smaller, and the platinum-group powder may be simply interspersed on the top of barrier rib 34.

Hydrogen-absorbing materials 38 are disposed on the top of barrier rib 34 in the second exemplary embodiment, but hydrogen-absorbing materials 38 may be disposed on the surface of barrier rib 34 other than the top of barrier rib 34. When barrier rib 34 has a porous structure, a similar effect can be obtained even if hydrogen-absorbing materials 38 are contained in barrier rib 34.

Third Exemplary Embodiment

Figure 4:
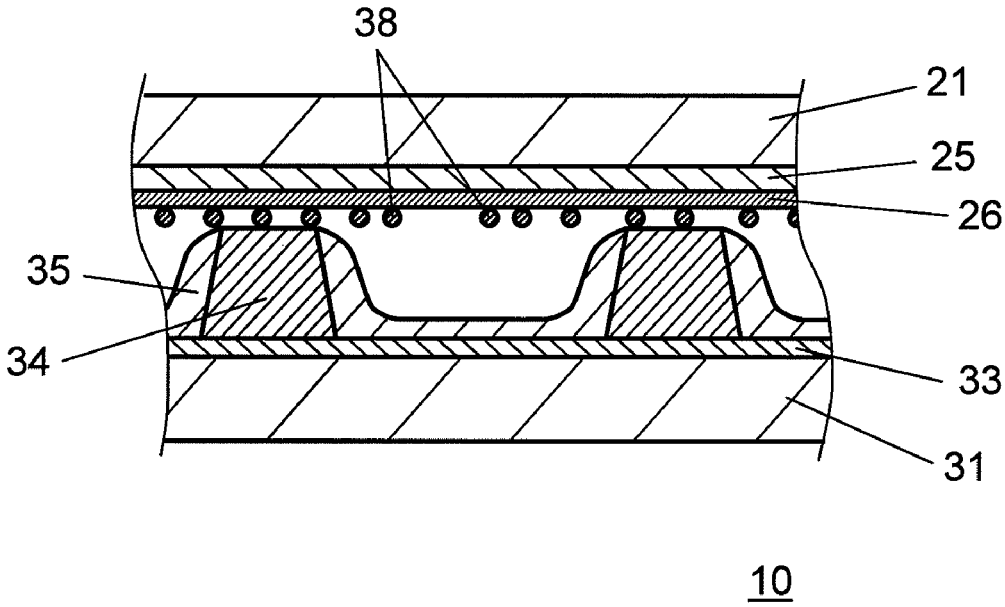
FIG. 4 is a sectional view of the PDP in accordance with a third exemplary embodiment of the present invention.

PDP 10 of the third exemplary embodiment of the present invention differs from the first exemplary embodiment in that hydrogen-absorbing materials 38 are disposed on protective layer 26 of front substrate 21 in the third exemplary embodiment. FIG. 4 is a sectional view of PDP 10 in accordance with the third exemplary embodiment of the present invention, and schematically shows hydrogen-absorbing materials 38 dispersed on protective layer 26.

Similarly to the second exemplary embodiment, the grain size of the platinum-group powder used as hydrogen-absorbing materials 38 in the third exemplary embodiment must be set so that a large distance does not occur between barrier rib 34 and protective layer 26, and is preferably 0.1 to 5 μm. The coverage factor at which the platinum-group powder covers protective layer 26 is preferably set to 50% or lower so as to prevent the platinum-group powder from disturbing the transmission of visible light.

As discussed in the first through third exemplary embodiments, hydrogen-absorbing materials 38 such as palladium are disposed in the PDP. In the first through third exemplary embodiments, impure gas such as water molecules and hydrocarbon molecules having a large molecular diameter is not adsorbed as it is, but hydrogen-absorbing materials 38 such as palladium for absorbing and storing much hydrogen generated by decomposition following the discharge are disposed inside the PDP to significantly reduce the water and hydrocarbon. As a result, the discharge characteristic is stabilized, the variation with time is suppressed, and the luminance reduction of the phosphor can be suppressed.

The specific numerical values or the like used in the first through third embodiments are just one example, and are preferably set to optimal values in response to the specification of the PDP or the specification of the PDP material.

As is clear from the above-mentioned descriptions, the present invention can provide a PDP that sufficiently removes impure gas such as water or hydrocarbon and suppresses the degradation of the protective layer and the phosphor.

The present invention is useful as a PDP, because it can sufficiently remove impure gas such as water or hydrocarbon and can suppress the degradation of the protective layer and the phosphor.

The invention claimed is:

1. A plasma display panel comprising:

a front substrate including a plurality of display electrode pairs, a dielectric layer, and a protective layer; and a rear substrate including a plurality of data electrodes, a barrier rib, and a phosphor layer, wherein said front substrate and said rear substrate face each other so that said display electrode pairs and said data electrodes intersect, and so that said protective layer faces said phosphor layer, and wherein a hydrogen-absorbing material is disposed on said protective layer so as to face said phosphor layer; and wherein said hydrogen-absorbing material covers 50% or less of said protective layer.

2. A plasma display panel comprising:

a front substrate including a plurality of display electrode pairs, a dielectric layer, and a protective layer; and a rear substrate including a plurality of data electrodes, a barrier rib, and a phosphor layer, wherein said front substrate and said rear substrate face each other so that said display electrode pairs and said data electrodes intersect, and so that said protective layer faces said phosphor layer;

wherein a hydrogen-absorbing material is disposed on said protective layer so as to faced to said phosphor layer; and wherein said hydrogen-absorbing material contains a platinum-group powder; and a grain size of said platinum-group powder is 0.1 to 5 μm.

3. The plasma display panel of claim 2, wherein said hydrogen-absorbing material including a platinum-group powder is mixed in said phosphor layer, and a mixing ratio to powder of phosphor in said phosphor layer is 0.01% to 2%.

4. A plasma display panel comprising:

a front substrate including a plurality of display electrode pairs, a dielectric layer, and a protective layer; and a rear substrate including a plurality of data electrodes, a barrier rib with a top, and a phosphor layer, wherein said front substrate and said rear substrate face each other so that said display electrode pairs and said data electrodes intersect;

a hydrogen-absorbing material including a platinum-group powder is disposed on said top of said barrier rib;

a grain size of said platinum-group powder is 0.1 to 5 μm; and a thickness of said platinum-group powder layer is 5 μm or lower.

5. A plasma display panel comprising:

a front substrate including a plurality of display electrode pairs, a dielectric layer, and a protective layer; and a rear substrate including a plurality of data electrodes, a barrier rib, and a phosphor layer, wherein said front substrate and said rear substrate face each other so that said display electrode pairs and said data electrodes intersect, and so that said phosphor layer faces said protective layer;

a hydrogen-absorbing material is disposed on said phosphor layer so as to face said protective layer; and said hydrogen-absorbing material covers 50% or less of said phosphor layer.

* * * * *